United States Patent [19]

Hoetzl et al.

[11] Patent Number: 4,963,091

[45] Date of Patent: Oct. 16, 1990

[54] METHOD AND APPARATUS FOR EFFECTING CONVECTIVE HEAT TRANSFER IN A CYLINDRICAL, INDUSTRIAL HEAT TREAT FURNACE

[75] Inventors: Max Hoetzl; James A. Brandewie, both of Toledo, Ohio; Thomas M. Lingle, Temperance, Mich.

[73] Assignee: Surface Combustion, Inc., Maumee, Ohio

[21] Appl. No.: 425,686

[22] Filed: Oct. 23, 1989

[51] Int. Cl.[5] ..... F27D 11/02

[52] U.S. Cl. ..... 432/176; 432/205; 432/199; 432/234; 126/21 A

[58] Field of Search ..... 432/176, 199, 234, 250, 432/209, 205; 126/21 A

[56] References Cited

U.S. PATENT DOCUMENTS

| | | | |
|---|---|---|---|
| 3,091,445 | 5/1963 | Toney | 432/176 |
| 3,620,513 | 11/1971 | Wernicke | 432/176 |
| 3,905,760 | 9/1975 | Johansson et al. | 432/176 |
| 4,094,631 | 6/1978 | Grieve | 432/176 |
| 4,395,233 | 7/1983 | Smith et al. | 432/176 |
| 4,648,377 | 3/1987 | Van Camp | 126/21 A |
| 4,722,683 | 2/1988 | Roger | 432/176 |
| 4,789,333 | 12/1988 | Hemsath | 432/176 |
| 4,813,398 | 3/1989 | Savage | 432/176 |
| 4,836,776 | 6/1989 | Jomain | 432/176 |
| 4,854,863 | 8/1989 | Hemsath | 432/176 |
| 4,854,863 | 8/1989 | Hemsath | 432/21 |
| 4,867,132 | 9/1989 | Yencha | 126/21 A |

*Primary Examiner*—Henry C. Yuen

*Attorney, Agent, or Firm*—Body, Vickers & Daniels

[57] ABSTRACT

A low cost, improved convective heat transfer furnace is disclosed which includes a cylindrical casing to which is attached blanket insulation and the casing is closed at its ends to define a closed end cylindrical furnace enclosure. An annular fan face plate is positioned within the enclosure to define a pressure zone on one side and a work zone on the other side. A paddle wheel fan in the work zone develops a large mass of circumferentially swirling wind which is initially formed as a stationary swirling mass without an axial force component but which under pressure travels axially in the form of a swirling annulus through the non-orificing annular space. The under pressure zone established by the central opening in the fan face plate causes the swirling wind annulus in the work zone to expand radially inwardly and uniformly impinge the complete surface of the work in an effective heat transfer manner before being recirculated back to the pressure zone.

11 Claims, 10 Drawing Sheets

METHOD AND APPARATUS FOR EFFECTING CONVECTIVE HEAT TRANSFER IN A CYLINDRICAL, INDUSTRIAL HEAT TREAT FURNACE

This invention relates generally to the industrial heat treat field for metal articles and more particularly to method and apparatus for effecting convective heat exchange in an industrial heat treat furnace.

The invention is particularly applicable to industrial heat treat furnaces of the low temperature type commonly known in the trade as draw or temper furnaces and will be described with particular reference thereto. However, it will be appreciated by those skilled in the art that the invention has broader application and may be applied to other industrial heat treat furnaces such as atmosphere heat treat furnaces.

INCORPORATION BY REFERENCE

The following patents are incorporated by reference herein and made a part hereof:

(a) Jomain U.S. Pat. No. 4,836,766

(b) Hemsath U.S. Pat. No. 4,787,333

(c) Smith U.S. Pat. No. 4,395,233

The patents are incorporated as background material so that the description of the invention herein need not define what is conventionally known in the art. The background patents do not form part of the present invention.

BACKGROUND

Industrial heat treat furnaces are conventionally designed for the particular heat treat process which is to be accomplished by the furnace. Obviously, a furnace developed for heat treat processes requiring temperatures in excess of 2000° F. requires different heat transfer considerations than a furnace designed to heat the work at temperature ranges of approximately 1000° F. Also, should the process temperature be further reduced to approximately 500° F., ovens using panel construction are used in place of furnaces.

There are a number of industrial applications where metal parts must be tempered after quenching and it is simply not economically feasible to effect tempering in high temperature, heat treat furnaces. Alternatively, the customer may desire to temper the work himself. Such considerations have resulted in a market for draw or temper furnaces typically operating at temperatures of about 1250° F. or at about 800° F. At such temperatures, heat transfer with the work is principally achieved by convection. Traditionally, convection is achieved by simply mounting fans in box type furnaces which use a baffle arrangement to cause circulation of the heated atmosphere or wind with the work. The market for tempering furnaces obviously represents the low price end of the heat treat furnace market and is intensely cost-competitive.

For several years now, metallurgical process requirements have been consistently tightened to require closer control of the temperature uniformity in the work to produce higher quality parts. It is not uncommon for a customer to require a total heat treat temperature spread of no more than 10° F. (i.e. ±5° F.). A furnace designer confronted with such requirement must first design the furnace to achieve temperature uniformity at any point within the furnace enclosure without a load present. Only after temperature uniformity has been achieved in the furnace design does the focus next turn to the process time-temperature requirements for the work, i.e. heat transfer rate. As appreciated by those skilled in the art, any number of factors can result in a heat sink, heat source or hot spots produced within the furnace enclosure which prevents achievement of the desired temperature uniformity. The temperature uniformity problem is further complicated because the heat transfer medium itself can produce temperature deviations such as heat transfer by radiation conflicting with heat transfer from convection, etc.

A number of furnace designers believe that the traditional box furnace configuration is not conductive to achieving uniform temperature distribution within the temperature ranges required in today's market. Accordingly, positive pressure, batch type cylindrical furnaces have been developed in the belief that such furnaces inherently will eliminate hot spots or heat sinks when compared to the box furnace. Again, the underlying premise is that if the furnace temperature can be maintained within the temperature uniformity requirements anywhere within the furnace enclosure, then in time the work temperature will homogenize itself to that of the furnace temperature.

As a practical matter however, economic considerations dictate, at least with respect to operating temper furnaces, that each batch be processed in as quick a time as possible. This is traditionally accomplished by means of baffles, distribution plates, dampers and/or nozzles which direct the heated, furnace atmosphere or wind against the work. An example of such an arrangement is shown in FIG. 1 which illustrates a commercially successful, prior art cylindrical temper furnace developed by the assignee of the present invention. In the cross-sectional schematic of FIG. 1, the work "W" is shielded on three sides by a housing "H" connected to a fan plenum "P". A baffle "B" and adjustable dampers "D" insure an atmosphere flow about work "W" to effect uniform convective heat transfer within a satisfactory temperature range. Note that fan "F" is typically mounted through the cylindrical furnace casing. While the temper furnace disclosed in FIG. 1 does meet temperature uniformity requirements, nevertheless the fan mounting, the baffling and housing increases the furnace cost. Also, the pressure of such structure inherently effects temperature uniformity. In addition, the fact that the dampers must be adjusted sensitizes, somewhat, the furnace operation although perhaps no more than that of the other prior art arrangements. The present invention is an improvement over the FIG. 1 prior art furnace.

The prior art thus far described, relates to batch type, positive pressure furnaces. There are, of course, vacuum furnaces in widespread conventional use in the heat treat field. Vacuum furnaces and variations thereof (such as ion nitriders) are double walled pressure vessels, and are typically formed as cylinders with spherical ends. It is to be appreciated that box type furnaces represent a configuration which cannot economically function as a pressure vessel. In a vacuum furnace, the work is heated and while under a vacuum, a treatment gas is backfilled into the chamber to impart the desired case properties into the work. The process cycle usually requires the work to be quenched after heating. A number of recent developments have been made in vacuum furnaces to permit the work to be rapidly gas quenched. The quench schemes use special nozzle distribution plates, baffles, dampers and the like, all of which are designed to blast the work with high speed gas jets. The concept is to impinge the entire surface of the work with turbulent gas jets to achieve a heat transfer rate which approximates a liquid quench. U.S. Pat. No. 4,836,766 to Jomain (incorporated herein by reference) illustrates a typical approach where baffling in combination with a high speed helical jet is used to spray the work in a gas quench. Traditionally, a liquid quench is effected in a separate chamber of the furnace at atmosphere pressure.

There are numerous, convective heat transfer arrangements in the prior art and it is known to use the intake of a fan as a centrally positioned under pressure zone to cause recirculation of furnace atmosphere. This is shown, for example, in the baffled arrangement of the Jomain patent. There are variations. In U.S. Pat. No. 4,789,333 assigned to Gas Research Institute (incorporated herein by reference) a free-standing circular jet is developed through an orifice and expanded into turbulent contact with a cylindrical shell member as the jet travels the length of the cylindrical shell. At the end of the shell, the jet is redirected by a special diverter plate to impinge the work and the spent jet is then collected through the under pressure zone to be recirculated. While such an arrangement appears satisfactory to effect high temperature heat transfer with a thin shell, the turbulence caused by the jet would have a deleterious effect on the insulation in a temper furnace. U.S. Pat. No. 4,395,233 to Smith et al (incorporated herein by reference) also illustrates the use of a central under pressure zone to cause recirculation of forced air in a baking oven. However, Smith's oven is rectilinear in configuration and this will cause turbulence at the oven corners, and while this may be acceptable at the relatively low pressures in an oven application, such an arrangement is unacceptable at the high mass flow rates required in furnace applications. None of the arrangements is sufficient to develop the "wind" pattern required in the heat treat furnace applications to which the present invention is concerned.

SUMMARY OF THE INVENTION

It is thus a principal object of the invention to provide a low cost industrial heat treat furnace which has improved convective heat transfer characteristics.

This object along with other features of the invention is achieved in an industrial heat treat furnace which includes a cylindrical casing having a sealable door at one open axial end while its opposite axial end is closed. An annular fan face plate is concentrically positioned within the casing and defines (i) a cylindrical pressure zone which extends between the fan plate and the closed axial end and (ii) a cylindrical work zone which extends between the fan plate and the door end. The fan plate has a central opening and an outside diameter which importantly is smaller than the diameter of the casing such that a non-orificing annular space exists therebetween. A fan arrangement within the pressure zone develops a wind mass pressurized against and swirling about the cylindrical casing in an essentially non-turbulent manner at its interface with the casing. As the fan continues to pump and compress the wind mass in the pressure zone, the wind mass flows axially towards the door end of the furnace through the non-orificing annular opening in the form of a swirling annulus of wind. Because of the non-turbulent interface, the under pressure zone established at the central opening in the fan face plate is effective to cause the inside diameter of the wind annulus to expand radially inwardly in a controlled manner to uniformly impinge the work throughout its entire length and width prior to its recirculation as spent wind into the pressure zone. In accordance with a more specific and important feature of the invention, the circumferentially swirling wind as described is developed by a conventional fan having paddle-wheel type blades which produces the desired circumferential swirl but importantly does so in a wind pattern which has no significant spiral twist or axial component formed by the fan impeller.

In accordance with another significant feature of the invention, the cylindrical work zone is characterized in that it is completely devoid of any baffles, dampers, jackets, shrouds, or additional pressure nozzles resulting in an economical furnace, stable in operation and inherently better able to achieve temperature uniformity than prior art devices.

In accordance with another aspect of the invention, the furnace simply comprises an outer steel casing formed as a cylindrical shell with a circular end plate at one end of the shell and an annular door end plate at the opposite shell end. A conventional wedge-shaped door sealing against the annular door end plate provides a simple furnace closure. Within the work zone a flue opening extends through the shell generally adjacent the door end plate and the only protrusion in the work zone is a conventional work support mechanism for supporting open meshed or closed side work baskets. Exposed blanket insulation secured to the shell, the end plates and the door permits the unobstructed furnace atmosphere flow through the work zone and the aforesaid combination results in an economical, easily fabricated furnace.

In accordance with more specific features of the invention, a heat source is placed in the pressure zone so that the spent wind through conduction, convection and radiation can be brought to the furnace operating temperature in the pressure zone. Preferably, the source of furnace heat comprises a burner extending through the cylindrical casing in the pressure zone and orientated to direct its products of combustion tangential to the circumference of the cylindrical casing. Alternatively, the source of heat can comprise electric heating elements disposed within the pressure zone and preferably in the form of an equilateral triangle connected to a three phase power source. Further, a heat treating atmosphere gas can be supplied to the pressure zone to impart certain desired physical properties to the workpieces being heat treated so that the furnace can operate as an atmosphere furnace. Additionally, a cooling arrangement can be provided in the pressure zone to effect fast cooling of the workpieces in a manner similar to that described for heating the workpieces.

In accordance with another feature of the invention, a method and system of industrial heat treating is provided by using convective heat transfer in a cylindrically shaped furnace by means of the fan face plate establishing a nonorificing annular space between the plate and the cylindrical casing and then rotating the paddle bladed fan at a speed sufficient to (i) compress the wind mass radially outwardly against the cylindrical enclosure so that the wind mass circumferentially swirls about said cylindrical enclosure in an initially stationary manner without an axial force component, (ii) force, by fan pressure, the swirling wind mass axially through the annular space so that the wind mass, in the form of an annulus, axially travels towards the closed end of the work zone with the annulus of wind being non-turbulent at its interface with the cylindrical enclosure and (iii) establish an under pressure zone at a central open in the fan face plate to cause the wind mass to expand radially inwardly towards the center of the work zone to impinge the work in a uniform manner while the swirling wind mass travels the length of the work whereby the temperature of the wind mass is substantially imparted to the work before being drawn into the under pressure zone.

In accordance with another specific object of the invention, the temperature uniformity of the work, whether the work is placed in a closed basket or a mesh basket, does not exceed a total variation of 10° F. even through the mass flow can vary anywhere from 250 to 3000 cubic feet per minute.

It is thus an object of the present invention to provide a low-cost, easily assembled industrial heat treat furnace.

It is another object of the present invention to provide an industrial heat treat furnace with improved convective heating.

It is yet another object of the invention to provide an industrial batch type furnace which is able to maintain temperature uniformity of the work within close tolerances.

Yet another object of the invention is to provide an industrial heat treat furnace which is able to effect convective heat transfer in a rapid manner.

Still yet another object of the invention is to provide a furnace process which uses an especially formed wind flow pattern to effect convective heat transfer with the work in a recirculating mode.

Yet another object of the invention is to provide a convective heat transfer industrial furnace which is able to heat the work by either gas or electric burners.

Still yet another object of the invention is to provide an industrial heat treat furnace which is capable of circulating a heat treating gas about the work.

Still another object of the invention is to provide a heat treating furnace which is capable of rapid cooling of heated work.

Another object of the invention is to provide a heat treating furnace which does not use any baffles, dampers, pressure nozzles and the like to effect convective heat transfer.

Yet another object of the invention is to provide a low-cost furnace which is stable in operation.

A further object of the invention is to provide a heat treat furnace where the maximum temperature at any point in the work during heat up does not exceed, to any significant degree, the furnace temperature.

A still further object of the invention is to provide a heat transfer arrangement which can effect rapid heating and cooling of the work.

These and other objects and advantages of the invention will become apparent from a reading of the Detailed Description section taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE INVENTION

Figure 1:
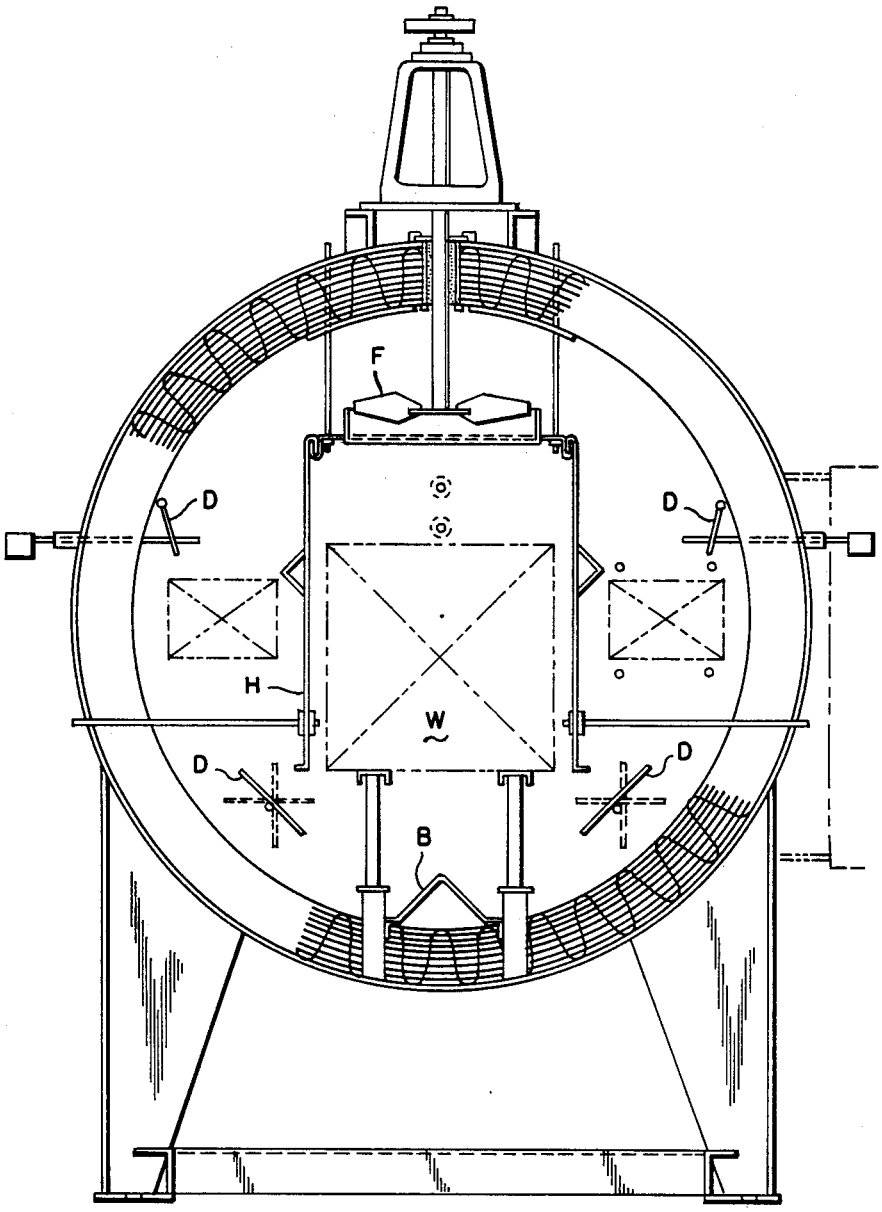
FIG. 1 is a sectioned, end elevation view of a prior art, cylindrical heat treat tempering furnace.
Figure 2:
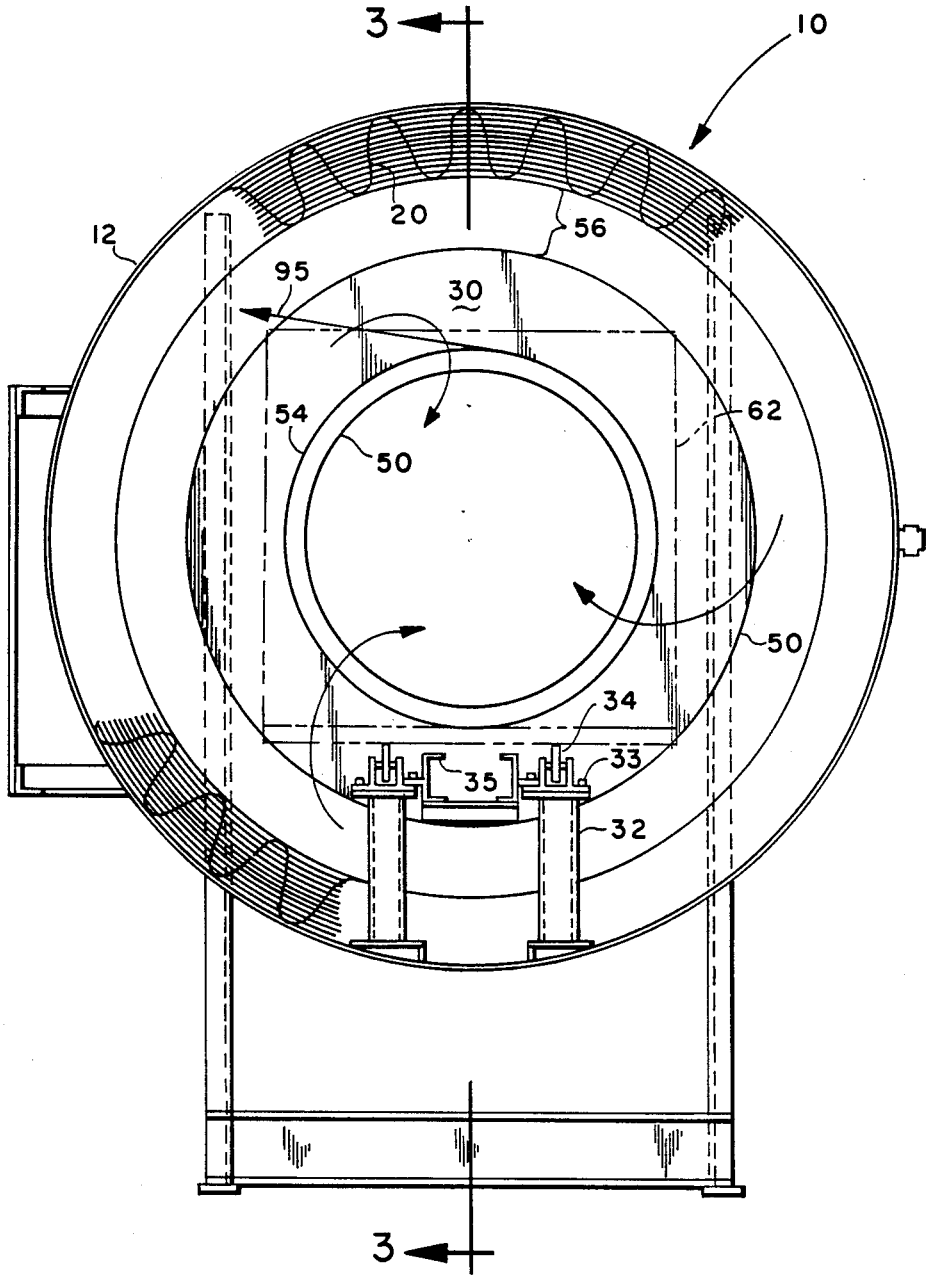
FIG. 2 is a sectioned, end elevation similar to FIG. 1 of the furnace of the present invention.
Figure 3:
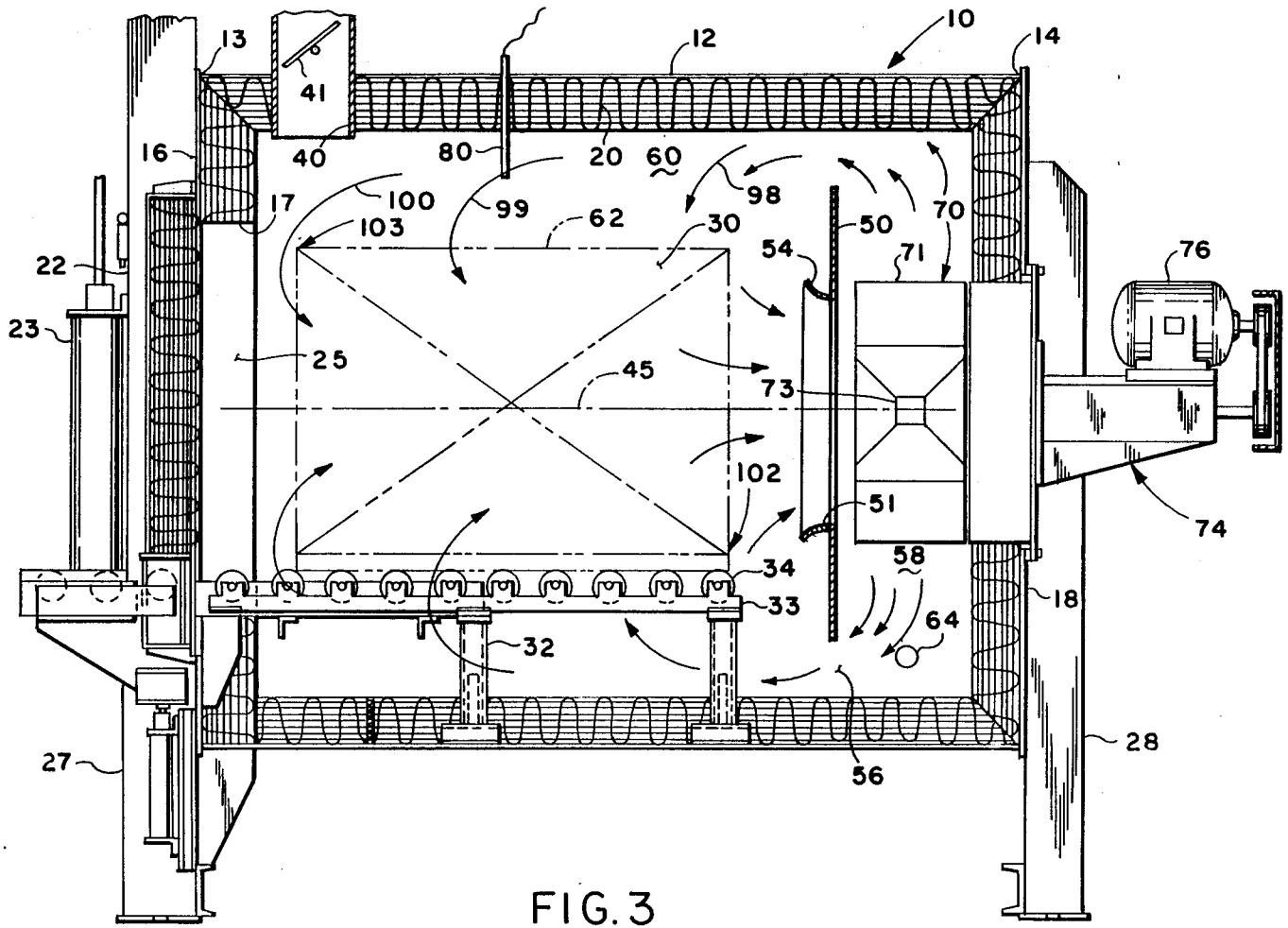
FIG. 3 is a longitudinally sectioned view of the furnace of the present invention taken generally along lines 3—3 of FIG. 2.

Referring now to the drawings wherein the showings are for the purpose of illustrating the preferred embodiment of the invention only and not for the purpose of limiting the same, there is shown in FIGS. 2 and 3 a furnace 10. In the preferred embodiment, furnace 10 is a low temperature furnace using convective heat transfer to heat the work and is typically known as a draw or temper furnace. Such furnaces typically operate at temperature ranges of about 1250° F. or about 800° F.

Furnace 10 includes a cylindrical casing 12 which has at one axial end an open door end 13 and a closed end 14 at its opposite axial end. An annular door casing 16 is secured to open end 13 to define a furnace opening 17 and an annular closed casing 18 is secured to closed end 14. All furnace casings 12, 16 and 18 are conventional structural plates (plain, cold rolled steel) approximately 3/16 to 5/16" thick. Secured to the interior of casings 12, 16 and 18 is a vacuum-formed, ceramic fiber insulation of a relatively high density, i.e. 15 lbs./ft$^2$. The surface of the insulation is sprayed with a conventional silica sand mixture to make it hard and rigid. This type of insulation is conventionally known and readily available in the trade from a number of sources and is thus not shown or described further in detail herein. Insulation 20 is secured to casings 12, 16 and 18 in a conventional manner which is not shown or described herein in detail. While insulation 20 is conventional, it is a specific aspect of the invention that an inner steel lining need not be applied to the hot face of the insulation because, although high mass flow rates are generated in the invention, the wind or mass flow is not significantly turbulent at the insulation interface and will not erode the insulation. Thus, a liner need not be used.

Closing furnace opening 17 is a conventional wedge tight door 22. As known to those skilled in the art, cylinder 23 vertically raises or lowers door 22 and rollers (not shown) at the sides of door 22 rolling within a cam track (not shown) push or wedge door 22 into sealing contact with annular door casing 16 to seal furnace opening 17. While this is a conventional door mounting, it should be noted that insulation 20 on door casing 16 protrudes inwardly of door 22 and this arrangement provides a recess area 25 at open end 13 of furnace 10. Recess 25 does not have any deleterious effect on the wind or mass flow of the present invention and there is no need to use a more complicated or expensive door arrangement which would align itself with insulation 20 on door casing 16.

Secured to door casing 16 is a furnace support leg structure 27 and secured to closed end casing 18 is a similar furnace support leg structure 28. Furnace 10 is not supported by any structure secured to cylindrical casing 12 to minimize expense.

Cylindrical casing 12, door casing 16, closed end casing 18 and door 22 define a cylindrical furnace enclosure indicated generally by numeral 30. Adjacent door end 13 is a work support structure which includes a plurality of rail support posts 32 which are secured to the interior surface of cylindrical casing 12 and which carry a longitudinally extending rail 33 which in turn carries a plurality of alloy rollers 34 and a chain guide 35 so that the work can be chain driven on rollers 34 into and out of furnace enclosure 30 in a conventional manner. Also adjacent door end 13 is a furnace flue 40 which extends through cylindrical casing 12 and is in fluid communication with furnace enclosure 30. A damper 41 is provided in furnace flue 40 to control the exhaust of furnace atmosphere and pressure within furnace enclosure 30 in a known manner. Flue 40 does not adversely affect or short circuit the wind pattern developed in furnace enclosure 30.

Concentrically positioned about longitudinal centerline 45 of furnace enclosure 30 is an annular fan face plate 50. Fan plate 50 has a circular central opening 51 which will define an under or negative pressure zone as hereafter explained. To enhance the under pressure zone a flange, in the form of a curved frusto-conical section 54 is added to one side of fan face plate 50. Again, mouth section 54 is added to enhance the funnelling aspects of the under pressure zone created by central opening 51. The outside diameter of fan face plate 50 is less than the inside diameter of circular casing 12 to define a non-orificing annular space 56 therebetween. Importantly, annular space 56 does not act as an orifice for reasons which will be hereafter discussed. Face plate 50 is firmly suspended within furnace enclosure 30 at a fixed distance from closed end 14 by circumferentially spaced thin rods (not shown) which extend through and are secured to circular casing 12. Alternatively, the rods could extend through and be secured to closed end casing 18. As thus far defined, fan face plate 50 divides furnace enclosure 30 into a pressure zone 58 which extends from one side of fan face plate 50 to closed end 14 and a work zone 60 which extends from the opposite side of fan face plate 50 to open end 13.

Work zone 60 with the exception of the work support structure is entirely free or devoid of any baffles, dampers, nozzles or any other wind directing structure. Workpieces to be tempered are conventionally placed loose in work baskets or trays indicated by the dot-dash line 62 shown in FIGS. 2 and 3. Baskets 62 are conventionally known in the trade and are rectangular boxes open at the top with a wire mesh bottom and either having closed sidewalls or wire mesh sidewalls. As will be explained hereafter, the convective heat transfer aspects of the invention will work equally well whether baskets 62 have closed or wire mesh sidewalls.

Figure 4:
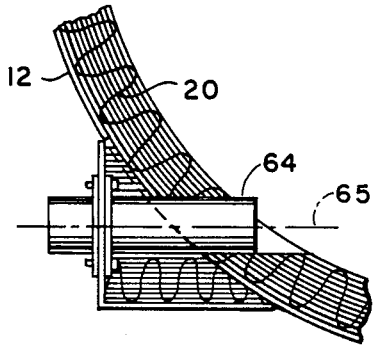
FIG. 4 is a detail showing the burner position in the furnace of the present invention.
Figure 6:
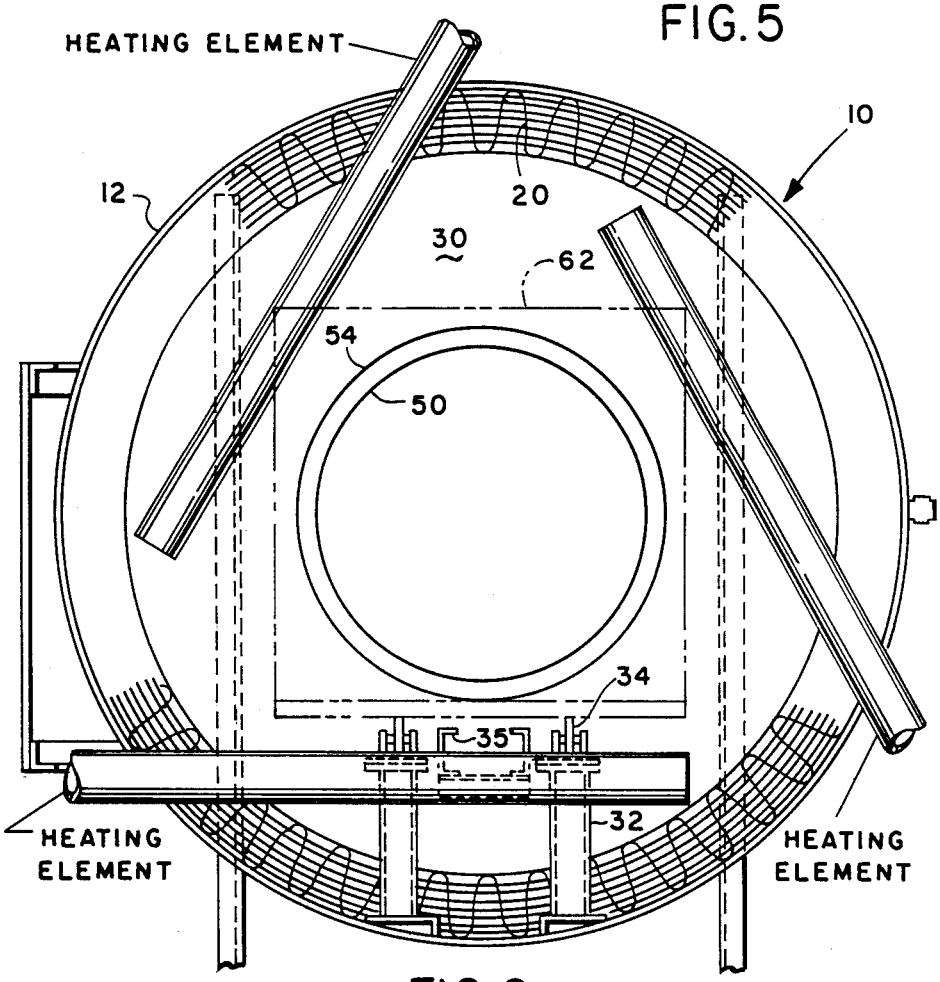
FIG. 6 is a schematic, end view of a portion of the furnace showing a modification thereto.

Within pressure zone 58 and as best shown in FIGS. 3 and 4, there is positioned a burner 64 which is mounted to and extends through cylindrical casing 12. Optionally, there are two burners 64 diametrically opposed to one another and oriented to fire their products of combustion in opposite directions so that the products of combustion of one burner add to the products of the other burner as they travel circumferentially about cylindrical casing 12. While not readily apparent in FIG. 4, burner axis 65 of each burner 64 is oriented so that the products of combustion fire tangentially about cylindrical casing 12. The valve train for burner 64 is not shown. Those skilled in the art understand from any number of various valve train arrangements that it is possible to shut off the flow of fuel to the burners and allow air to exit burner 64 if cooling of work chamber 60 at ambient temperatures is desired. It is also understood that burners 64 possess appropriate turndown ratios for temperature and mass flow considerations. Alternatively, as diagrammatically illustrated in FIG. 6, electric heating elements 67 could be used in place of burner 64. Electric heating element 67 would be positioned adjacent closed casing 18 and secured to closed casing 18. Preferably, heating element 67 would comprise three equal length bayonet elements 69 arranged in the form of an equilateral triangle wired in Delta or Wye connection to a three phase convention power supply.

Within pressure zone 58 is a fan 70 having paddle wheel blades 71. In the preferred embodiment, fan 70 has two paddle wheel blades 71 connected to a shaft 73 positioned on furnace longitudinal center line 45 and journaled in an appropriate mounting structure 74 secured to the outside surface of closed end casing 18 and belt driven by an appropriate motor 76 attached to mounting structure 74. Fan 70, per se is conventionally available from any number of fan manufacturers. For the furnace sizes discussed below, fan 70 was sized for trays A–C, specifically tray B and, in the preferred embodiment disclosed, has a rated capacity of 7000 CFM. In this regard, furnaces 10 are typically sized relative to the size of the work basket 62 which can be positioned within work zone 60. The standard sizes, then, of the work trays or baskets 62 for the tempering furnaces of the preferred embodiment are as follows:

| | WIDTH X | LENGTH X | HEIGHT |
|---|---|---|---|
| A | 24 | 30 | 24 |
| B | 36 | 48 | 36 |
| C | 36 | 72 | $36 = \frac{72}{45}$ 10,500 |

Also for further reference purposes, the inside diameter of cylindrical casing 12 including blanket insulation 20 is approximately 5′ 2⅝″ and the length of work zone 60 is dependent on the length of work basket 62 but would be approximately the work basket length plus an additional 8 to 10″ of space on either side of work basket 62. The length of pressure zone 58 is dependent upon paddle blade size and the specific type and configuration of the heating mechanism used within pressure zone 58 and also any cooling mechanism employed.

OPERATION

Figure 7:
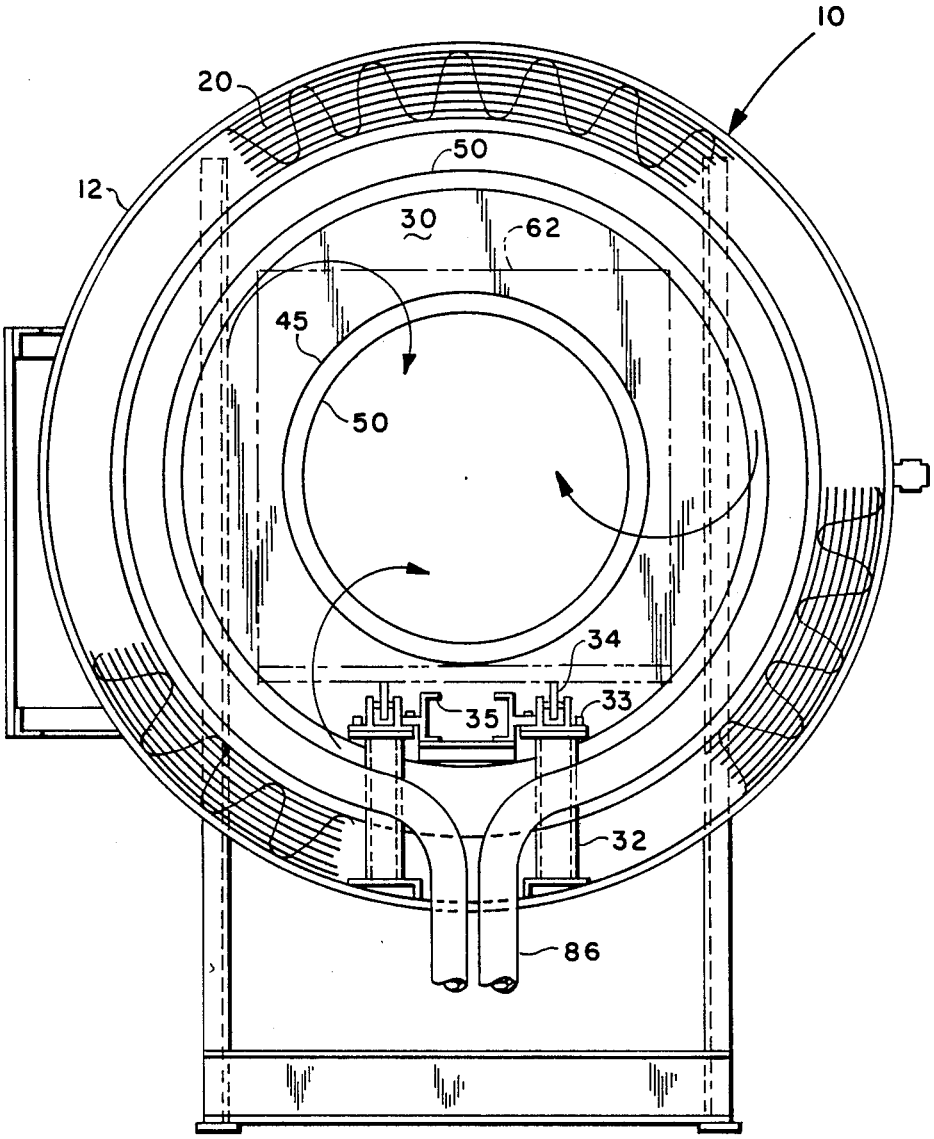
FIG. 7 is an end view of the furnace showing an additional modification thereto.

In general, furnace 10 is operated in a conventional manner. Workpieces packed in open mesh or closed sided baskets 62 are conveyed into work zone 60, door 22 is sealed, burners 64 are actuated and fan 70 causes heat from burners 64 to circulate in the furnace atmosphere, i.e. wind, and impinge the workpieces in work baskets 62. A thermal couple 80 extending through cylindrical casing 12 approximately midway relative to the position of work basket 62 measures the furnace temperature. When the furnace temperature reaches the tempering temperature the firing of the burner 64 is controlled in a conventional manner and the process continues at this temperature for a time equal to the metallurgical process time, i.e. the soak time. In the present invention, only thermal couple 80 is used to measure furnace temperature because of the excellent convective heat transfer characteristics of the invention. This further reduces the cost of furnace W. Optionally, an additional thermal couple can be positioned within the work and the process controlled by that thermal couple or by a comparison between the temperature of the work thermal couple and that of the furnace thermal couple 80. The work is maintained at the tempering temperature for a soak time dictated by the metallurgical requirements for the particular tempering process used. At the conclusion of the soak time, the work is typically furnace cooled which means that the work simply stays within the furnace until it drops to a particular temperature whereat it is removed. To speed the furnace cool time, fan 76 may be periodically activated with the burners, of course, shut off. Alternatively, and again depending upon the metallurgical process, air can be admitted through burner 64 and the work cooled. In certain applications involving brittle temper which require a fast cool cycle following the soak time, additional provisions may have to be made to furnace 10 to provide a heat sink within pressure zone 58. One such possible arrangement is a closed recirculating cooling loop 85 as shown in FIG. 7 which basically comprises a heat exchange conduit or tubes 86 adjacent closed end casing 18 and situated within pressure zone 58. Heat exchange conduit 86 has an exit end 87 in fluid communication with a heat exchanger 89 where the fluid medium in heat exchanger conduit 86 is cooled and then subsequently pressurized in a blower 90 and reintroduced into an inlet end 91 of the heat exchange conduit 86. It is a particular feature of the invention that the incorporation of the heat sink such as that disclosed in FIG. 7 permits the heat transfer characteristics of the invention to have application to both furnace heat and cool functions. Furthermore, it is possible to add a treating gas to work zone 60 through an appropriate metering nozzle (not shown) in pressure zone 58 or even through burners 64 with a conventional control arrangement regulating the metering nozzle and also baffle 41 so that the workpieces can be appropriately heat treated by the disassociation of the treating gas, etc. Thus, furnace 10 modified to include radiant heat (in the form of indirect heating coils or tubes in work zone 58 not shown) cooling in the form of the arrangement shown in FIG. 7 and the introduction of a heat treat gas renders the arrangement shown suitable for use as an atmosphere heat treating furnace with or without convective heating. Cost savings for a cylindrical, atmosphere heat treat furnace when compared to conventional box furnaces are significant. As used herein, atmosphere heat treat furnaces mean furnaces operated at or about standard atmosphere pressure as distinguished from vacuum furnaces which operate at significant negative pressure. Also as noted above, atmosphere furnaces operate at heat treat temperatures which are generally achieved through radiation.

Figure 9:
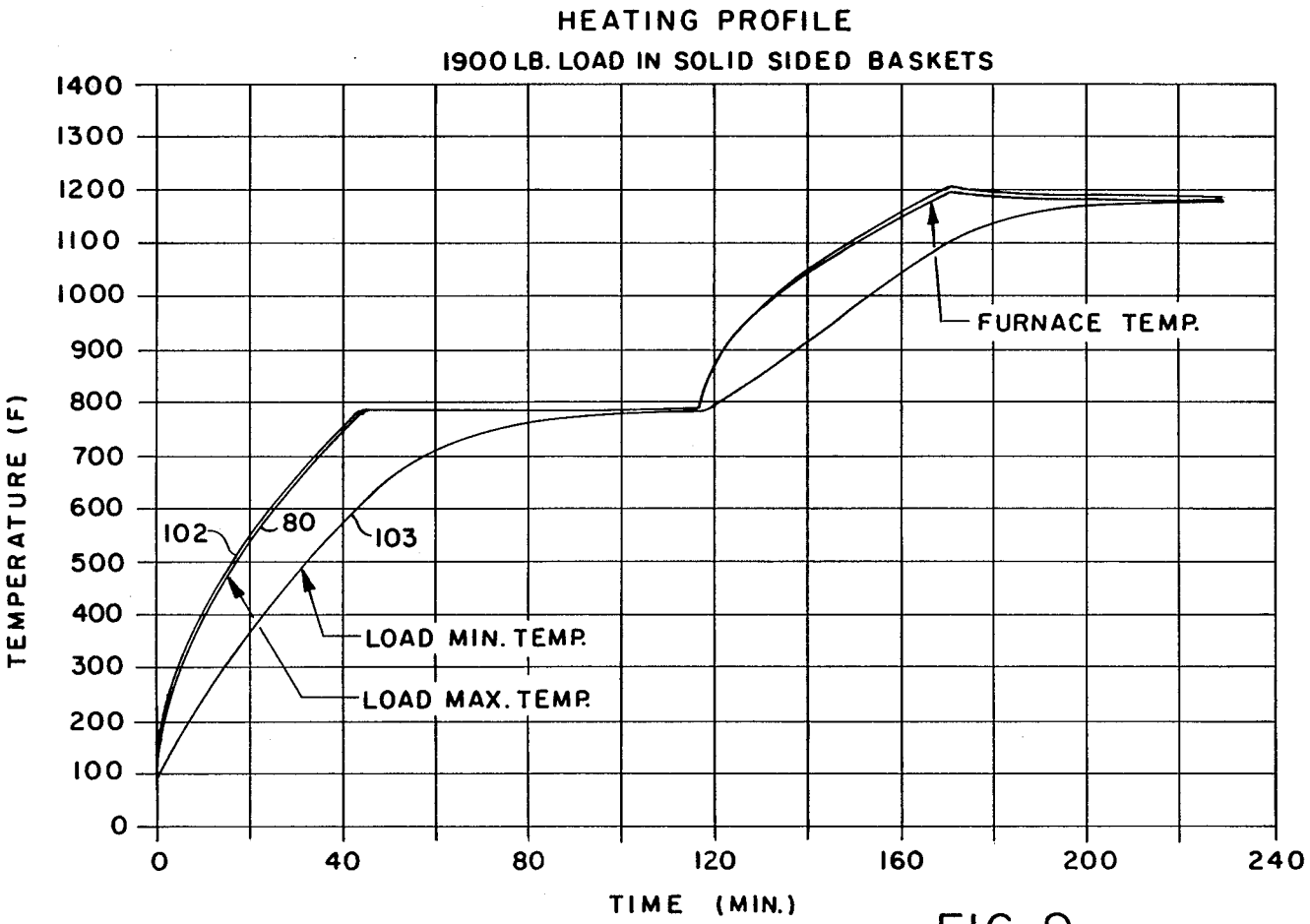
FIGS. 9 and 10 are graphs showing the heat profile of work loaded in solid sided and mesh sided work basket.
Figure 10:
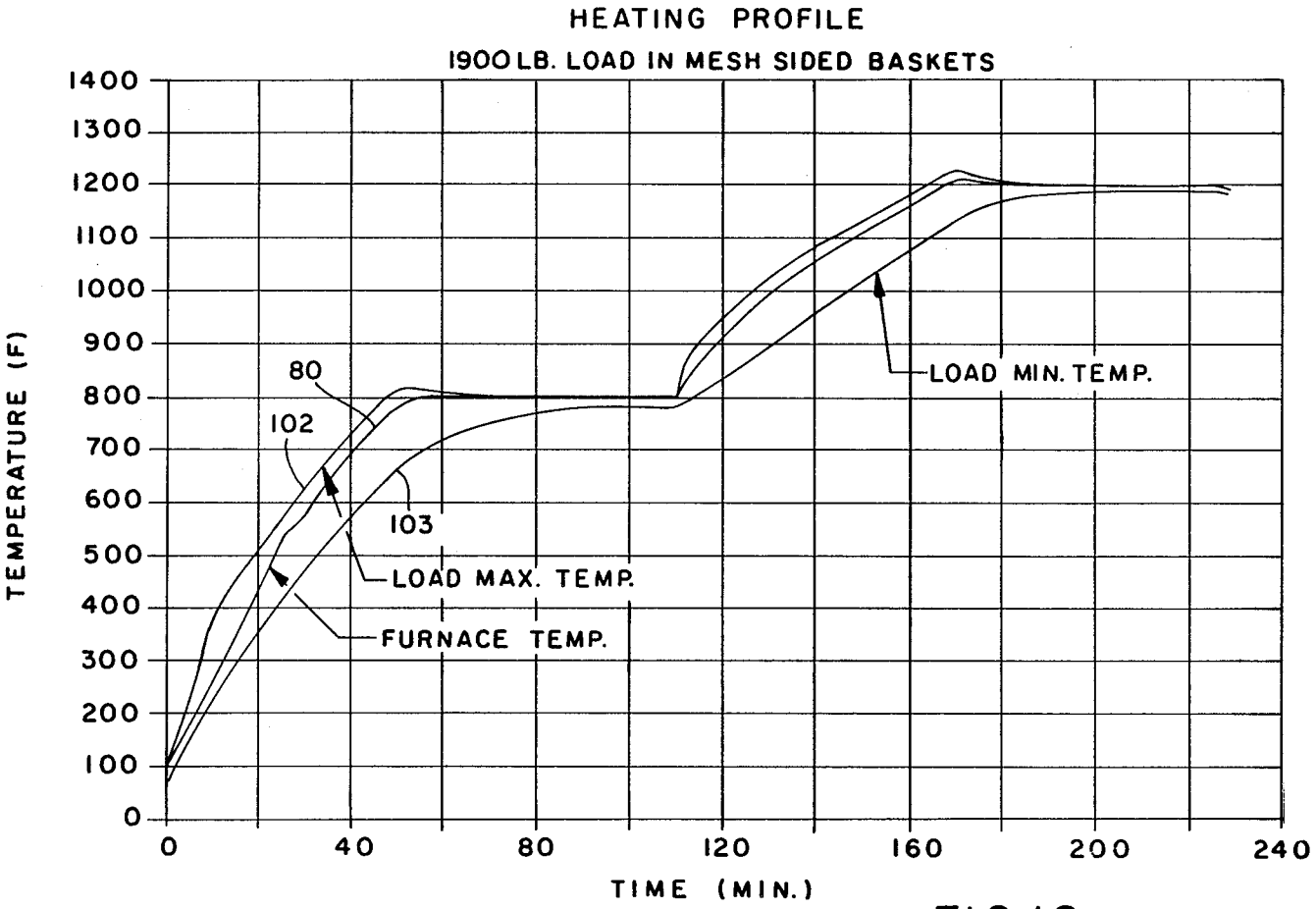
Figure 11:
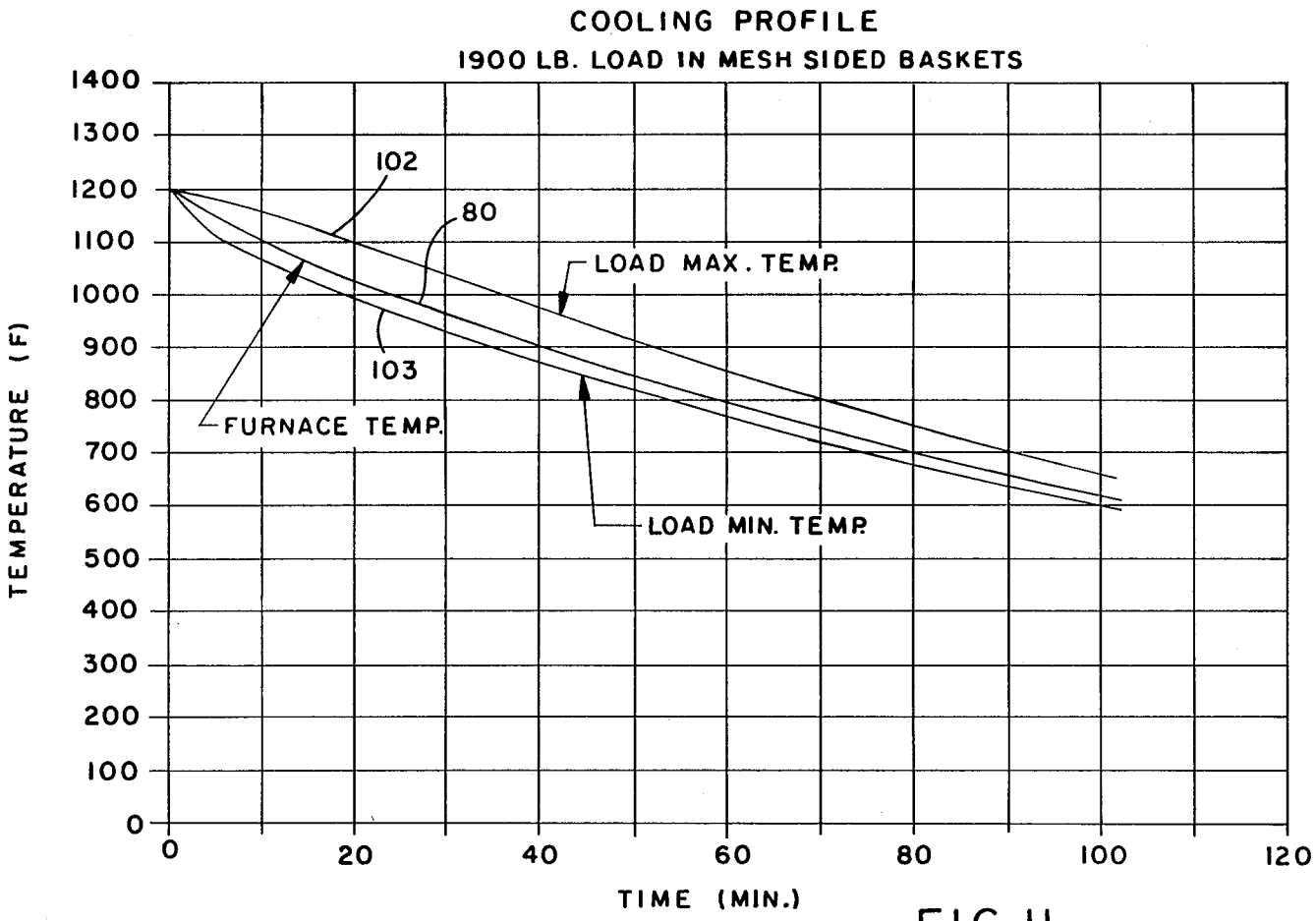
FIG. 11 is a graph showing a cooling profile of the present invention.
Figure 12:
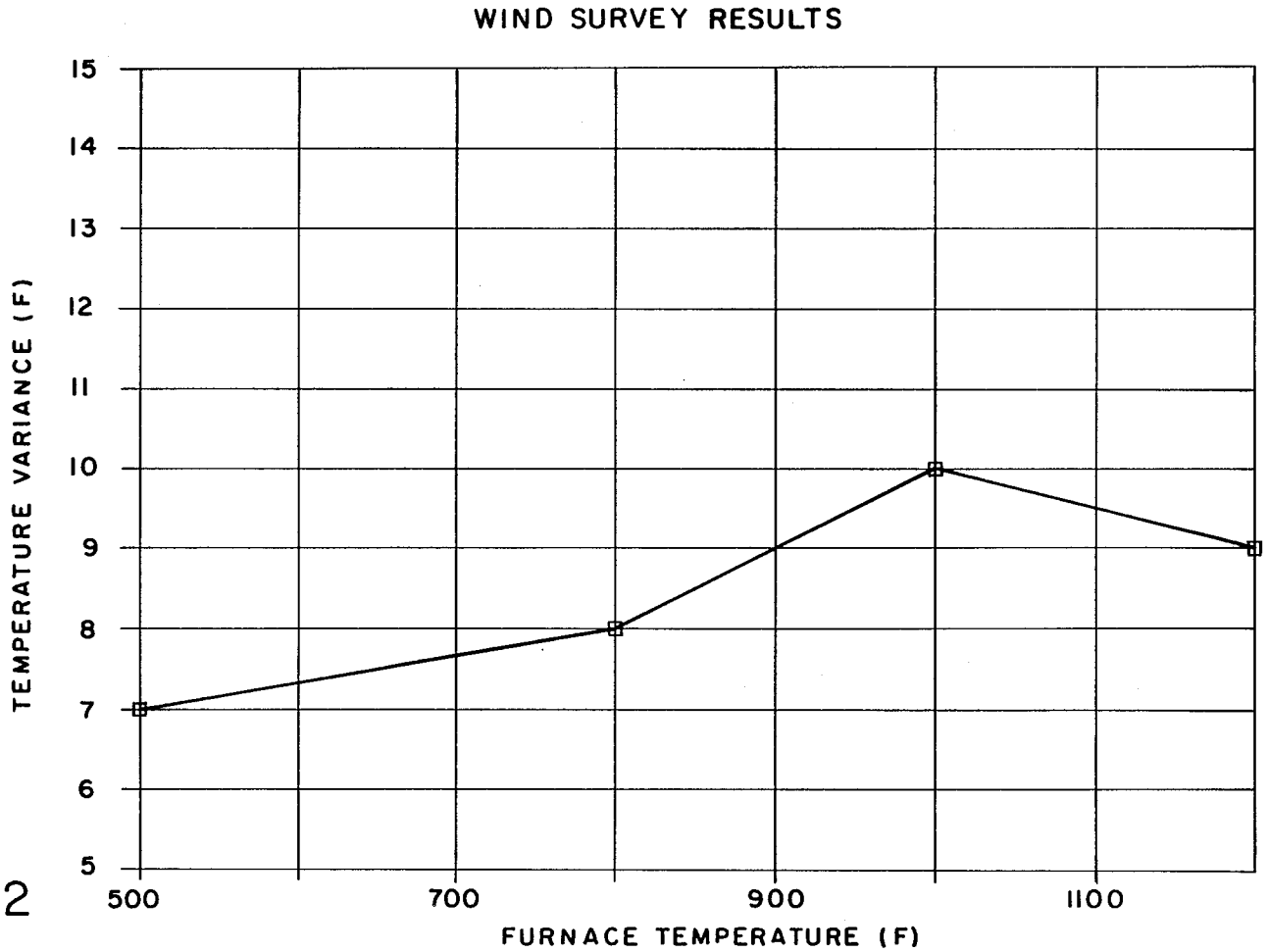
FIG. 12 is a graph showing temperature uniformity within the furnace at various furnace temperatures.

From streamer tests conducted about fan face plate 50 and from actual temperature profile tests as shown in FIGS. 9–11 and wind survey tests as shown in FIG. 12, it is known that turbulent air completely engulfs work basket 62 throughout its length and width and uniformly heats and cools the work therein whether the baskets are closed sided or open mesh. The operation of the invention will now be described in accordance with what is believed to occur within the furnace.

Figure 5:
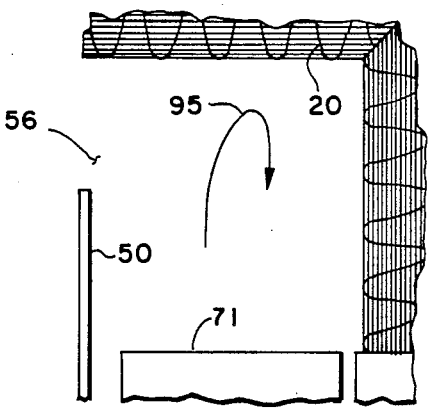
FIG. 5 is a schematic representation showing a diagram of the forces acting on the furnace atmosphere mass flow of the present invention.

While noted above that conventional paddle bladed fans are well known, applicants believe that it is important to use such a fan for the functioning of the invention. As best shown in FIG. 2, the rotation of the blades causes wind moving along the face of the blades to leave the fan in a generally tangential, spinning direction as shown by arrow 95. The wind spins until contact with cylindrical casing whereat it assumes a circumferential swirl about the cylindrical casing. This is again shown by curved arrow 95 in FIG. 5. This wind swirl is essentially normal to and about the furnace centerline 45. At the interface of the wind swirl with the casing the flow is non-turbulent. Other types of fans could produce turbulent flow at the casing or could produce swirling patterns that definitely have a spiral or helical motion imparted to the swirl to cause axial progression down the chamber. It is considered an important part of the invention that the fan produce a swirl which is not spinning in a helix or spiral manner. As fan 50 continues to rotate and more wind mass is added to pressure zone 58 the wind mass is pressurized and axially or longitudinally spreads out. In point of fact, it will dead end at one axial side at end plate 18 and produce turbulence therewith. However, the wind mass will travel at the other axial side through non-orficing space 56. In fact, the swirling wind mass will assume the shape of an annulus equal to space 56 and will axially move, that is parallel to longitudinal centerline 45, towards door end 16 of work zone 60. It is to be appreciated that the wind is swirling within the annulus as it enters work zone and the swirl speed can vary anywhere from 200 to 3,000 fpm, the upper limits of which may very well have a Reynolds number approaching that of a jet. However the axial speed of the swirl is certainly not that of a jet. Thus, the wind swirl is travelling axially at a relatively low speed.

As soon as the wind mass enters work zone 60, the under pressure zone defined by central opening 51 will cause the swirling wind annulus to expand radially inwardly. Referring to FIG. 3, the wind annulus could be viewed as containing various circular layers, the innermost layers indicated by arrow 98, being drawn by the under pressure almost immediately into contact with basket 22, the intermediate layers indicated by arrow 99 being drawn into contact with basket 62 by the time that particular wind mass has reached the middle of basket 62 while the outermost layer indicated by arrow 100 is pulled by the under pressure into contact with basket 62 adjacent casing door end 16. Of course, once the wind annulus which is swirling at relatively high speed makes contact with basket 62, turbulence immediately occurs and the impingement produces the desired heat exchange with the work before the spent wind is pulled into central opening 51 and recycled or recirculated. Thus, the speed of the swirl is used to cause a very large mass of wind to react turbulently or even violently with the work to produce high heat transfer between wind and work.

The cylindrical shape of the case, the fan, the non-orificing space, however, are believed to be all coacting with one another to produce the wind pattern which permits the under pressure zone to pull the wind into uniform contact with the entire length and width of basket 62 and thus the work therein. If the non-orificing space acted in the manner of a jet as disclosed in the Hemsath reference, the wind would not impact the work until it struck the furnace door. If there was significant turbulence due to a square casing configuration as shown in Smith, the wind mass might be short circuited, or if the wind were swirled with a spiral motion, the axial or longitudinal speed would be such that the under pressure zone would pull the wind annulus into work contact only after the wind mass traveled some distance into work zone 60. While it is appreciated that any of such arrangements, hypothetical or otherwise, will place the wind into heat transfer contact with the work, the uniformity of that contact will vary so that the temperature variations achieved in the present invention may not be ascertainable.

As noted in the background discussion above, the primary consideration in any furnace design is to develop a furnace enclosure which can maintain uniform furnace temperature at any point within the enclosure. That is, the space occupied by work basket or tray 62 must be able to maintain a uniform temperature irrespective of any time or heating rate considerations. Inherent in any furnace construction are cold and hot spots where the temperature is simply drained or the heat is simply focused, the cumulative effect of which prevents the furnace from achieving temperature uniformity within metallurgically specified ranges. Traditionally, furnace manufacturers have claimed close temperature ranges for their furnace designs. However, temperature measuring instruments lacked the sophistication of recording the temperature deviations at the temperature ranges which the furnace has been operated at. Recently, sophisticated electronic devices have been developed which can accurately sense temperature deviations of a couple of Fahrenheit degrees at high furnace temperatures. Using such state of the art temperature measuring devices, FIG. 11 shows the total variation in degrees Fahrenheit of the temperature of the work in the furnace when that temperature is homogenized or in a steady state. The total temperature variation does not exceed 10° F., i.e. ±5° F. The hottest point in the work in the steady state condition is indicated by reference numeral 102 in FIG. 3 and the coldest point is indicated by reference numeral 103. It is believed that the hottest point 102 is affected by burner 64 generating radiant heat to the innermost support post 32 which in turn is conducting the heat to the area designated as 102. If tighter temperature variations were imposed, a different burner position or, alternatively, the electrical bayonet heating arrangement disclosed in 56 would in all probability tighten the temperature variation. If the cold spot designated by numeral 103 then became the limiting factor, the fan output could be changed. However, the temperature variation shown in FIG. 11 is more than sufficient to meet stringent temperature uniformity requirements imposed in today's temperature furnace specification requirements. Again, it is noted that the absence of obstructions within work zone 60 contributes to the ability of the furnace of the present invention to meet temperature uniformity requirements since such obstructions cannot function as heat sources or sinks since they obviously do not exist. The only potential obstruction is the work support structure which does, as discussed with reference to FIG. 11, result in the highest heated work area. This is a significant aspect of the invention separate and apart frm the convective heat transfer features of the invention yet directly arising therefrom. That is, the cylindrical shape allows the furnace to achieve inherently superior temperature uniformity because of the absence of obstructions within the furnace and the "open" cylindrical shape is made possible because of the convective heat transfer arrangement disclosed.

Figure 8:
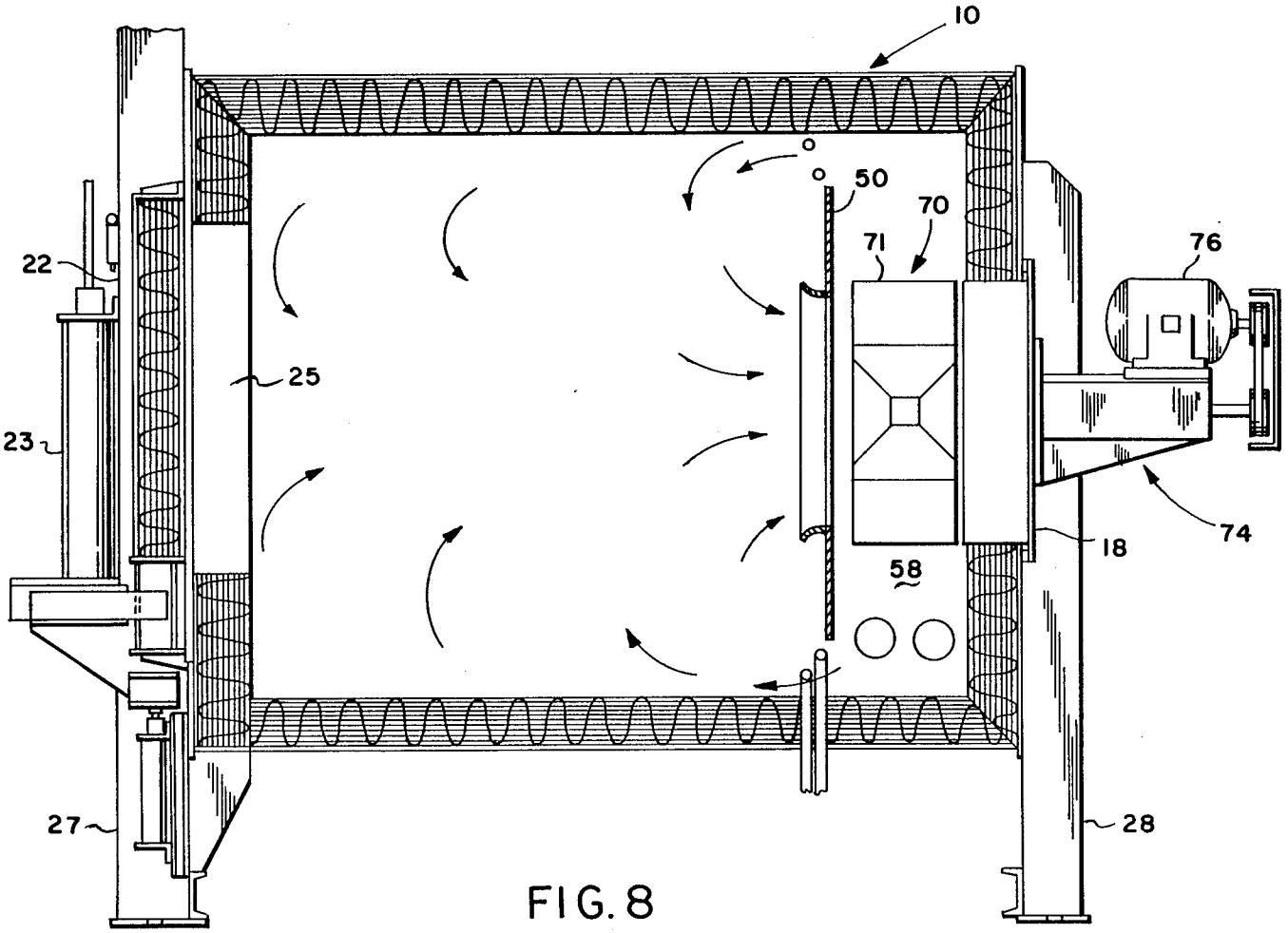
FIG. 8 is a longitudinal sectioned view of a portion of the furnace showing the modifications of FIGS. 6 and 7.

Once the temperature uniformity is achieved, a secondary but important consideration, insofar as heating is concerned, is the rate at which heat transfer can be effected to reduce process time without overheating or pegging any portion of the work. FIGS. 8 and 9 shows the heat profile generated for a solid side and open or mesh sided baskets 62 and a typical heat tempering cycle. Note that the overshoot of the hot spot 102 is very close in both instances to the final tempering temperature, i.e. either 800° to 1200° F. The lag in the temperature rise of the coldest part of the work is not significant since it is made up in the soak portion of the temper cycle. What is also significant is that the rate of heat transfer for the coldest part is approximately equal to that of the heat transfer rate for the hottest part.

Finally, FIG. 10 illustrates the cooling profile of the invention when the work is furnace cooled. That is, burners are simply shut off and the atmosphere is continued to be circulated by fan 70. Again, the rate of cooling for the hottest spot, 102, the coldest spot 103 and the furnace temperature as measured by thermal couple 80, after an initial discrepancy to account for the spread, is uniform. Thus, the graphs, singularly and collectively, indicate that the convective wind is uniformly impinging the work over its entire surface and is achieving significantly high convective heat transfer rates in the process.

Also, it should be noted that the applications under discussion are limited to positive pressure furnaces and heat treat processes performed therein. Within the heat treat art certain developments have been made in the vacuum furnace area where high speed multiple jets are used to cool the workpieces to avoid liquid quench bath chambers. Because of the intensity of the multiple jet impingements, higher heat transfer rates can be achieved in those applications than in the present invention. For example, heat transfer rates for jet cooling arrangements as high as 25–30 BTU/HR/FT$^{2}$° F. have been achieved while the present arrangement would produce cooling rates in the order of 10–15 BTU/HR/FT$^{2}$° F. However, vacuum furnaces are expensive, double walled cylindrical pressure vessels are used for certain closely controlled heat treat applications whereas atmosphere or positive pressure type furnaces are typically used in heat treat applications which do not necessarily require such high cooling rates and/or cost considerations preclude high speed jet impingement arrangements.

The invention has been described with reference to a preferred embodiment. Modification and alterations will occur to others upon reading and understanding the present invention. It is our intention to include all such modifications and alterations insofar as they come within the scope of the present invention.

Having thus described the invention, we claim:

1. An industrial heat treat furnace for thermally treating loose work pieces placed in baskets comprising:

(a) a cylindrical casing with blanket insulation secured thereto defining an open smooth cylindrical furnace enclosure closed at one axial end by a furnace wall and having a sealable door to close the opposite axial end;

(b) an annular fan face plate concentrically positioned within said casing and defining a cylindrical pressure zone axially extending between said fan plate and said closed end and a cylindrical work zone axially extending between said fan plate and said door end where work to be heat treated is positioned;

(c) fan means within said pressure zone for developing within said pressure zone a wind mass pressurized against and swirling about said insulation in an essentially non-turbulent manner said fan means including a paddle wheel fan having paddle wheel impellers extending radially outward from said fan's rotating shaft to direct said wind mass against said insulation as a swirling mass which initially tends to be stationary without an axial force component;

(d) said fan face plate having an outside diameter which is smaller by a predetermined distance than the inside diameter of said insulation to define a non-orificing annular space, said fan means in combination with said non-orificing annular space and smooth cylindrical casing effective to cause said wind mass to continuously exit said pressure zone through said non-orificing annular space in the form of an annular wind mass and axially travel at a low speed relative to its circumferential speed, in said work zone, towards said door while said wind mass swirls about said insulation in a non-turbulent manner at the interface of said insulation with said wind mass;

(e) means situated within said furnace enclosure to change the temperature of said wind relative to the work; and (f) said fan face plate having a generally central opening therein, said fan means in combination with said central opening forming under pressure zone means, said under pressure zone means effective to cause inner diameter portions of said annular swirling wind mass to impinge said work along the entire length and width of said work prior to the spend wind mass returning to said pressure zone through said central opening for achieving substantially uniform convective heat transfer with said work.

2. The furnace of claim 1 wherein said mass flow varies anywhere from 240 to 3000 fpm in a non-free-standing jet manner and said insulation includes a vacuum-formed ceramic fiber of high density, said ceramic fiber directly exposed to said wind mass.

3. The furnace of claim 1 wherein said means for changing said temperature includes means for heating said wind mass situated within said pressure zone whereby said wind mass heats said work by convection.

4. The furnace of claim 3 wherein said means for heating includes at least one burner extending into said cylindrical casing in said pressure zone and oriented relative to said cylindrical insulation to fire its products of combustion generally tangential to the curvature radius of said casing and perpendicular to the longitudinal axis of said casing.

5. The furnace of claim 1 wherein said means for changing said temperature includes three electrical heating elements of approximately equal length positioned in the shape of a triangle centered about the longitudinal axis of said casing, generally adjacent said closed end wall and contained substantially within the outside diameter of said fan face plate.

6. The furnace of claim 1 further including means to admit a treatment gas to said pressure zone and flue means adjacent said door end for controlling the egress of said wind mass from said work zone as well as the pressure developed within said furnace.

7. A system for heat treating metal workpieces placed loosely in an open or closed sided tray in a cylindrically shaped, sealed furnace enclosure comprising:

(a) an annular fan plate having a central opening therethrough perpendicular to the longitudinal center of said cylindrical enclosure, said fan plate defining a pressure zone extending from one end of said cylindrical enclosure to the side of said fan plate facing said one end and a work zone extending from the opposite end of said enclosure to the other side of said fan plate facing said opposite end said work zone defined as an open cylindrical configuration;

(b) a platform support in said work zone supporting said tray in an approximately centered relationship within said zone, said platform support and said tray comprising the only substantial obstruction within said work zone;

(c) means to generate a source of temperature within said pressure zone at a level different than the temperature of said work;

(d) said fan plate having an outer diameter less than the inside diameter of said cylindrical enclosure such that an annular space of predetermined radial distance exists between said work zone and said pressure zone said space defined as being non-orificing;

(e) fan means including a paddle bladed fan within said pressure zone to continuously pressurize a wind mass of spent furnace atmosphere within said pressure zone and in the process thereof:

(i) establish heat transfer between said spend mass and said source by conduction and convection to change the temperature of said mass in said pressure zone to a value tending to approximate the temperature of said source, (ii) compress said wind mass radially outwardly against said cylindrical enclosure so that said wind mass circumferentially swirls about said cylindrical enclosure in an initially stationary manner without an axial force component, (iii) force, by fan pressure, said swirling wind mass axially through said annular space so that said wind mass in the form of a spinning annulus axially travels towards the closed end of said work zone, said wind annulus generally non-turbulent at its interface with said cylindrical enclosure, and (iv) establish an under pressure zone at the central opening of said fan plate to cause said wind mass to expand radially inwardly towards center of said work zone and to impinge said work and tray in a uniform manner while said swirling mass travels the length of said work zone whereby the temperature of said swirling mass is convectively imparted uniformly to all of said work before being drawn into said under pressure zone to achieve close temperature uniformity.

8. The system of claim 7 wherein said fan means is effective to uniformly effect heat transfer with said work within a total deviation of 10° F.

9. The system of claim 7 wherein said source of temperature is a heat source.

10. The system of claim 7 wherein said source of temperature is a heat sink in the form of a cooling coil.

11. The system of claim 10 wherein said source of temperature additionally includes a heat sink and means to alternately activate each source.

* * * * *